US006516178B2

(12) United States Patent
Fukushima

(10) Patent No.: US 6,516,178 B2
(45) Date of Patent: Feb. 4, 2003

(54) IMAGE FORMING APPARATUS HAVING THE CAPABILITY TO ADJUST FOR NON-STANDARD SIZE INPUT DOCUMENT AND RECORDING MEDIUM

(75) Inventor: Tamotsu Fukushima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/866,331

(22) Filed: May 25, 2001

(65) Prior Publication Data

US 2002/0003981 A1 Jan. 10, 2002

(30) Foreign Application Priority Data

May 25, 2000 (JP) ..... 2000-155294

(51) Int. Cl.[7] ..... G03G 15/00
(52) U.S. Cl. ..... 399/376; 399/81; 399/370
(58) Field of Search ..... 399/376, 370, 399/365, 75, 81, 86; 271/9.06

(56) References Cited

U.S. PATENT DOCUMENTS 4,851,883 A * 7/1989 Ito ..... 399/370
5,150,224 A * 9/1992 Mizude et al. ..... 399/370
6,285,842 B1 * 9/2001 Katamoto et al. ..... 399/81

FOREIGN PATENT DOCUMENTS

JP 61-059318 A 3/1986
JP 61-059318 * 3/1986

* cited by examiner

*Primary Examiner*—Susan S. Y. Lee
(74) *Attorney, Agent, or Firm*—David G. Conlin; William J. Daley, Jr.; Edward & Angell, LLP

(57) ABSTRACT

The image forming apparatus includes an original document size detector device for detecting a size of an original document to be processed and a non-standard size input instruction screen for inputting a size of an original document to be processed. Normally, the detector device detects the size of an original document, and the original document image data is processed based on the obtained original document size to reproduce an image on the recording material. The non-standard size input instruction screen includes an X key and a Y key that enable the operator to input a new original document size by inputting a difference between the actual document size and reference values, where the reference values are provided based on the original document size obtained by the detector device.

16 Claims, 7 Drawing Sheets

FIG. 8

| SIZE | WIDTH AND HEIGHT (mm) | |
|---|---|---|
| | X | Y |
| A 3 W | 4 5 7 | 3 0 5 |
| A 3 | 4 2 0 | 2 9 7 |
| A 4 | 2 1 0 | 2 9 7 |
| A 4 R | 2 9 7 | 2 1 0 |
| A 5 | 1 4 8 | 2 1 0 |
| A 5 R | 2 1 0 | 1 4 8 |
| A 6 R | 1 4 8 | 1 0 5 |
| B 4 | 3 5 3 | 2 5 0 |
| B 4 | 3 6 4 | 2 5 7 |
| B 4 | 3 5 6 | 2 5 4 |
| B 5 | 1 8 2 | 2 5 7 |
| B 5 R | 2 5 7 | 1 8 2 |

IMAGE FORMING APPARATUS HAVING THE CAPABILITY TO ADJUST FOR NON-STANDARD SIZE INPUT DOCUMENT AND RECORDING MEDIUM

FIELD OF THE INVENTION

The present invention relates to image forming apparatuses that after detecting the size of an original document to be processed or a recording material on which an image is to be recorded, normally process original document image data based on the obtained original document size information or recording material size information to form an image on the recording material of a corresponding size and when necessary, allow manual input of the original document size information or recording material size information.

BACKGROUND OF THE INVENTION

Digital copying machines and other image forming apparatuses are already commercialized with a function to produce an image with a desired appearance by executing predetermined processes, such as scaling up or down, displacement, and production of a repeated pattern, on an original document.

Such a digital copying machine needs, first of all, to recognize the size of the original document to scale up or down the original document image.

Accordingly, to recognize the original document size and scale up or down the original document image, the conventional digital copying machine is provided with an original document size detector device that detects the size of the original document placed on an original document platen. The provision of the size detector device enables detection of the original document size loaded in the device as long as it is one of limited number of standard sizes, including A3, B4, A4, and B5.

A scaling ratio is determined from the original document size detected by the original document size detector device and the size information on the recording material that is selectively fed from a paper feeder section in the digital copying machine. A scaling process is then performed on the original document image based on the scaling ratio.

Other needs to recognize the original document size occur when the digital copying machine displaces, or produces a repeated pattern from, the original document image.

Accordingly, the conventional digital copying machine is provided with an original document size detector device that detects the size of the original document placed on an original document platen, also to recognize the original document size and displace or produce a repeated pattern from the original document image. The original document size detector device detects the original document size as long as it is one of a limited number of standard sizes. A displacement of the original document image or the number of repeated images (the number of repetition), etc. are determined from the original document size detected by the original document size detector device and the size information on the recording material that is selectively fed from a paper feeder section in the digital copying machine, to perform various processes on the original document image.

The original document size detector device is for detecting an original document placed on the original document platen by means of sensors disposed on the bottom of the original document platen and determines the original document size based on specific combinations of output signals from the sensors in reference to standard sizes.

There are however many original documents that do not match any of the standard sizes. Especially, these copying machines are now no longer limited to use in offices, but installed in convenience stores and similar places to provide copy services to general users where the digital copying machines are increasingly required to handle original documents of non-standard sizes, such as magazines, small notebooks, and daily necessities.

Under the circumstances, problems occur with those sensors that are arranged to detect original documents of standard sizes; the sensors fail to precisely detect the size of an original document that does not conform to any standard size and consequently can provide only limited options in editing the original document image.

To respond to such needs, a scale-varying copying machine incorporating an original document size detector device and an original document size input device was invented as disclosed in Japanese Laid-Open Patent Application No. 61-59318/1986 (Tokukaisho 61-59318; published on Mar. 26, 1986).

The scale-varying copying machine is designed not only to automatically detect the original document size by means of the original document size detector device, but also to allow the user to manually input the original document size through the original document size input device.

However, in the foregoing conventional image forming apparatuses, the original document size detector device does not work in collaboration with the original document size input device; only one of the two devices that identify the original document size is actually used at a time.

Specifically, when the operation is switched from the original document size detector device to the original document size input device, in the original document size input device, the operator estimates the original document size numerically in reference to markings near the original document platen and input a result numerically by means of numeric keys.

Since the operator needs to make a direct input of numerical values through the original document size input device by means of numeric keys, the operation is troublesome to the operator and there is room to improve operability.

SUMMARY OF THE INVENTION

A first objective of the present invention is to offer an image forming apparatus with improved operability in manual input of the size of an original document or recording material.

To achieve the first objective, the image forming apparatus of the present invention includes:

original document size detector means for detecting a size of an original document to be processed; and original document size input means for allowing input of a size of an original document to be processed, wherein:

normally, the original document size detector means detects the size of the original document, and original document image data is processed based on obtained original document size information to reproduce an image on a recording material of a corresponding size; and the original document size input means is provided with original document reference value adjusting means that enables the operator to, when inputting the size of the original document, select and input new original document size information using value adjusting operation means, such as an incremental key or a decremental key, after reference values are provided based on original document size information obtained by the original document size detector means.

According to the arrangement, when the size information of the original document is to be input, the original document reference value adjusting means provides reference values based on original document size information obtained by the original document size detector means. When the size information of the original document is actually input, the operator selects and inputs new original document size information using the value adjusting operation means only by the deviation from the reference values. This facilitates the input of the original document size information.

Original document size information obtained by the original document size detector means, such as, standard size information comparable to the size of an original document fed into the device or size information corresponding to a predetermined size group, can be set in advance as reference values. The operator therefore only needs to adjust the values up or down from these reference values and thereby can cut short the time to operate the value adjusting operation means.

As a result, the image forming apparatus can successfully offer improved operability in manual input of original document size information.

Further, to achieve the first objective, the image forming apparatus of the present invention includes:

recording material size detector means for detecting a size of a recording material on which an image is recorded; and recording material size input means for allowing input of a size of a recording material on which an image is recorded, wherein:

normally, the recording material size detector means detects the size of the recording material and image data is processed based on the obtained recording material size information to reproduce an image on a recording material of a corresponding size;

the recording material size input means is provided with recording material reference value adjusting means that enables, when inputting the size of the recording material, selection and input of new recording material size information using value adjusting operation means, such as an incremental key or a decremental key, after reference values are provided based on recording material size information obtained by the recording material size input means.

According to the arrangement, when the size information of the recording material is to be input, the recording material reference value adjusting means provides reference values based on recording material size information obtained by the recording material size detector means. When the size of the recording material is actually input, the operator selects and inputs new recording material size information using the value adjusting operation means only by the deviation from the reference values. This facilitates the input of the recording material size.

Recording material size information obtained by the recording material size detector means, such as, standard size information comparable to the size of a recording material fed into the device or size information corresponding to a predetermined size group, can be set in advance as reference values. The operator therefore only needs to adjust the values up or down from these reference values and thereby can cut short the time to operate the value adjusting operation means.

As a result, the image forming apparatus can successfully offer improved operability in manual input of recording material size information.

The present invention will become more fully understood from the detailed description given hereinbelow and the accompanying drawings which are given by way of illustration only, are not in any way intended to limit the scope of the claims of the present invention.

BRIEF DESCRIPTION OF THE DRAWINGS

FIG. 8 is a list of original document or recording paper sizes that are detectable to the digital copying machine.

DESCRIPTION OF THE EMBODIMENTS

[Embodiment 1]

Referring to FIG. 1 to FIG. 8, the following will describe an embodiment of the present invention. The embodiment will be explained with a digital copying machine taken as a typical example of image forming apparatuses. The copying function of a digital copying machine is a known technology and a description thereof will be omitted.

The digital copying machine of the present embodiment includes an original document size detector device (original document size detector means) for automatically detecting a size of an original document placed at a predetermined position on an original document platen (glass platform).

Figure 1:
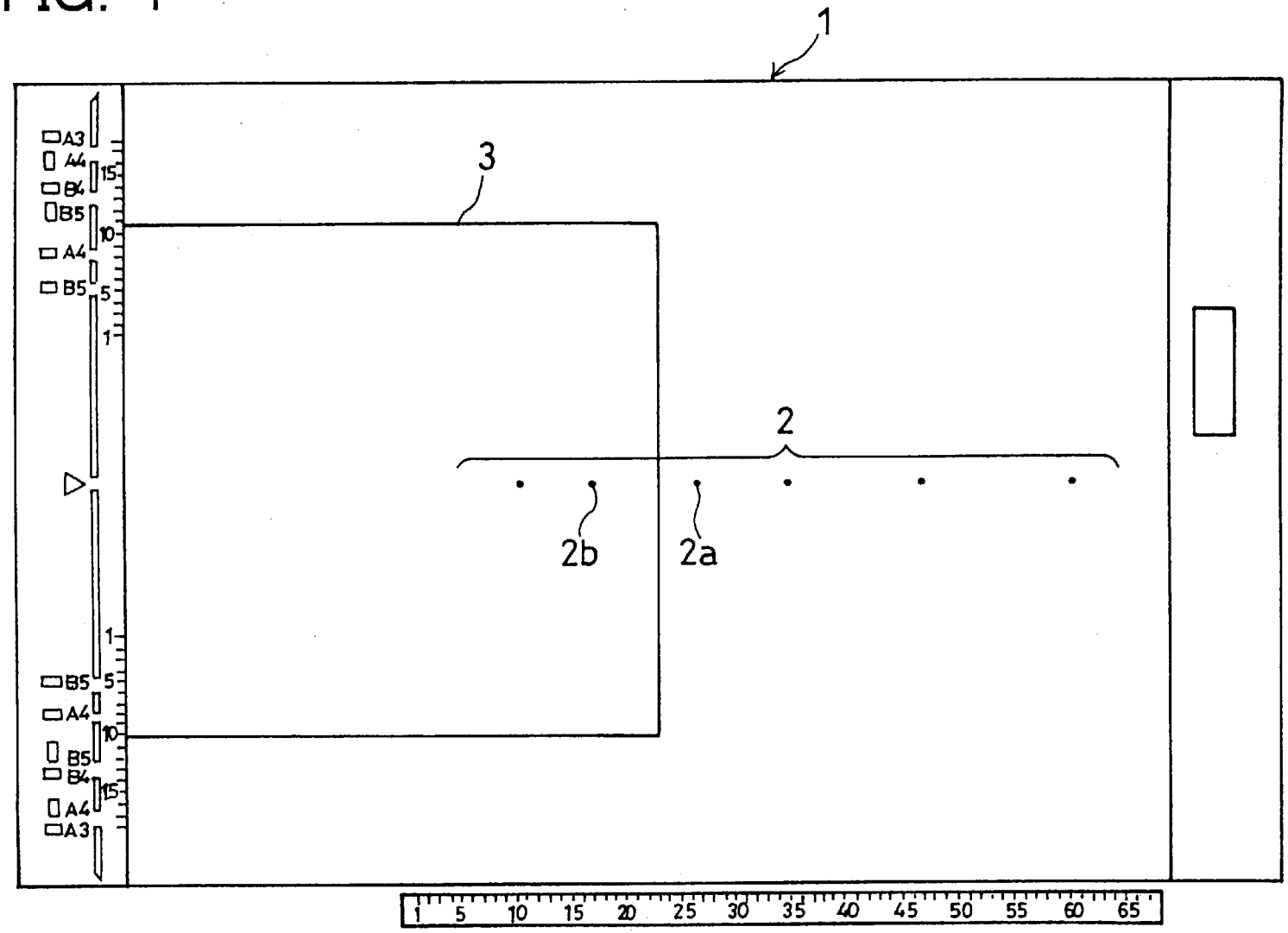
FIG. 1, illustrating an embodiment of the digital copying machine in accordance with the present invention, is a plan view showing an original document size detector device in a digital copying machine.

As shown in FIG. 1, the original document size detector device is constituted by optical sensors 2 disposed on the bottom of the original document platen 1. The optical sensors 2 are positioned corresponding to the right ends of the original documents of various sizes placed on the original document platen 1. The position of the rightmost one of the optical sensors 2 that have detected the original document is taken as being indicative of the size of the original document placed on the original document size.

The digital copying machine of the present embodiment either selects a recording paper size according to the original document size information obtained by the original document size detector device and the input scaling ratio or calculates a scaling ratio for selection according to the original document size information obtained by the original document size detector device and the paper size input.

For example, if a non-standard original document 3 placed on the original document platen 1 as shown in the figure, the right end of the non-standard original document 3 is positioned halfway between a B5R sensor 2*a* and a portrait A4 sensor 2*b*.

In this situation, the portrait A4 sensor 2*b* detects the original document, but the B5R sensor 2*a* does not. Accordingly, the original document size detector device assumes that the original document information is A4 portrait and carries out scaling and copying operations based on the scaling ratio set by the operator or the paper size.

However, the non-standard original document 3 is actually longer than A4 in the direction of scan illumination. Therefore, the original image is not correctly reproduced on paper (recording material) by such copying operations, with a part of the reproduced image missing from the paper.

To address this kind of problem, in the present embodiment, not only the original document size detector device can automatically detect the original document size, but the operator can also manually input the original document size information through a display section 30 (detailed later) of an operation panel if the operator so wishes.

Besides, the digital copying machine of the present embodiment automatically sets reference values based on the original document size information obtained by the original document size detector device before allowing an input of new original document size information. Operability is thus improved for the operator to manually input the original document size.

Now, the operation panel, in the digital copying machine of the present embodiment, through which the user can input the original document size information will be described.

Figure 2:
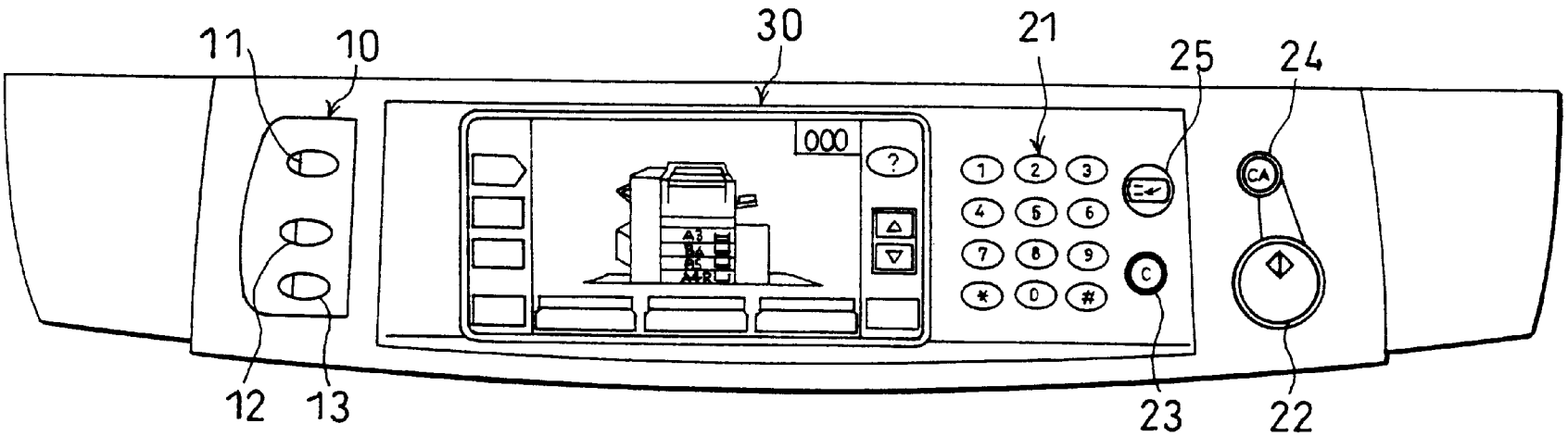
FIG. 2 is a plan view showing an operation panel of the digital copying machine.

As shown in FIG. 2, the operation panel of the digital copying machine is constituted by the display section 30 whose front surface is made of a transparent tablet and operation key arrays provided near the display section 30.

The display section 30 can switchably display various screens as detailed later. Each screen includes touch keys, allowing the operator to set various conditions on screen by directly pressing the touch keys.

One of the operation key arrays provided near the display section 30 is a function selector section 10 located to the left of the display section 30 as shown in the figure. The function selector section 10 is provided with a facsimile function key 11, a printer function key 12, and a copying machine function key 13. The digital copying machine can switchably execute three functions as facsimile, printer, and copying machines.

To the right of the display section 30 in the figure is there provided numeric keys 21, a start key 22, a clear key 23, a clear all key 24, and a interruption key 25.

The numeric keys 21 allow the operator to input numerical values as a response to an on-screen instruction on the display section 30. The start key 22 is used for the operator to give an instruction to start a copying operation. The clear key 23 is used when the operator wants to clear the settings displayed on the display section 30 or suspend a copying operation. The clear all key 24 is pressed when the operator is to restore copying conditions to default values. The interruption key 25 allows the operator to temporarily suspend the on-going copying process for another copying process.

Figure 3:
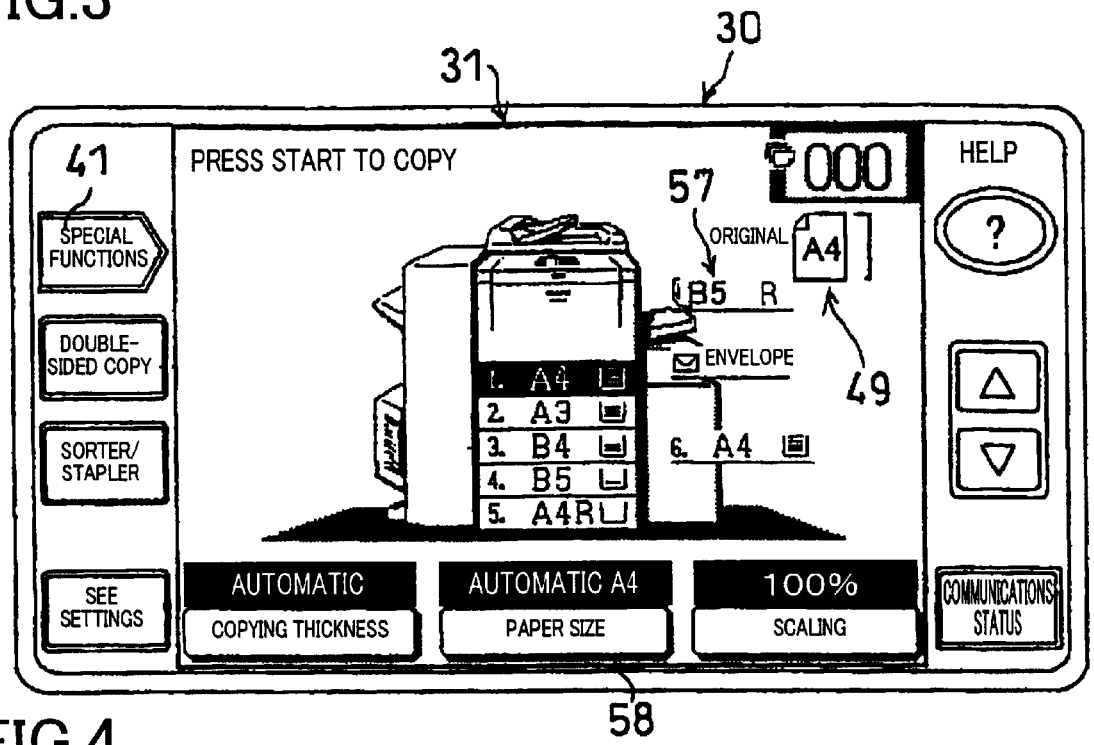
FIG. 3 is a plan view showing a default screen displayed on a display section of the operation panel of the digital copying machine.

In the digital copying machine, the size of the original document placed on the original document platen 1 with an end of the original document at a reference position is automatically detected by the original document size detector device mounted to the main body of the copying machine. Then, as shown in FIG. 3, the original document size is shown by a display of, for example, "A4" produced on the default screen 31 near the upper right corner of the display section 30 of the operation panel. In the present embodiment, as detailed later, no matter whether the original document is of a standard size or not, the original document size information as is obtained by the original document size detector device is shown by a display produced on a non-standard size input instruction screen 34.

The display on the display section 30 of the operation panel is sequentially changed as shown in FIG. 3 to FIG. 7, allowing the operator to create non-standard size information of the original document or recording paper by manual input.

The process of manual input is now described in line with changes of the display as illustrated in FIG. 3 to FIG. 7.

As the digital copying machine is turned on, the default screen 31 is displayed on the display section 30 of the operation panel as shown in FIG. 3.

Figure 4:
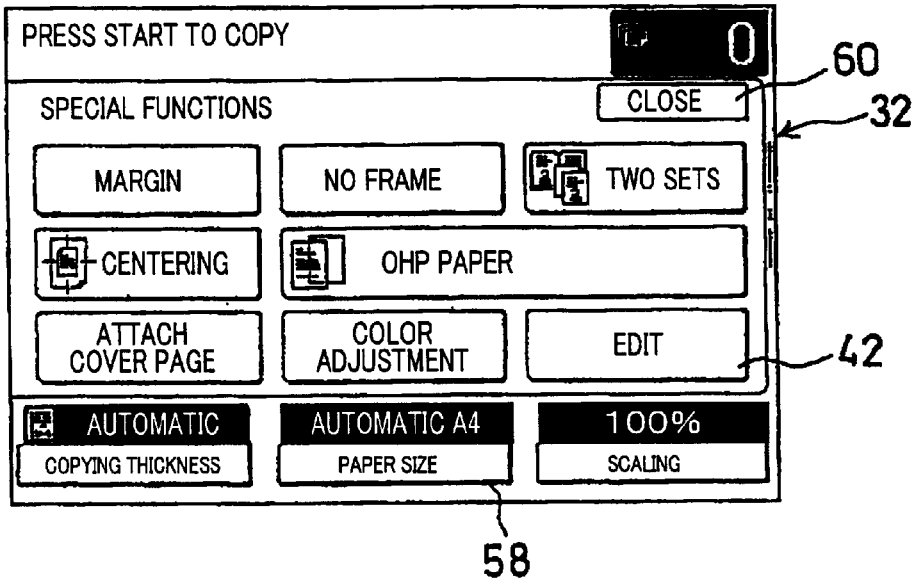
FIG. 4 is a plan view showing a special function selection screen displayed on the display section of the operation panel.

Pressing a special function key 41 appearing on the default screen 31 near the upper left corner of the display section 30 changes the display on the display section 30 to a special function selection screen 32 shown in FIG. 4. Selectively pressing an image edit menu key 42 among the special functions appearing on the special function selection screen 32 changes the display on the display section 30 to an image editor selection screen 33 shown in FIG. 5.

Figure 6:
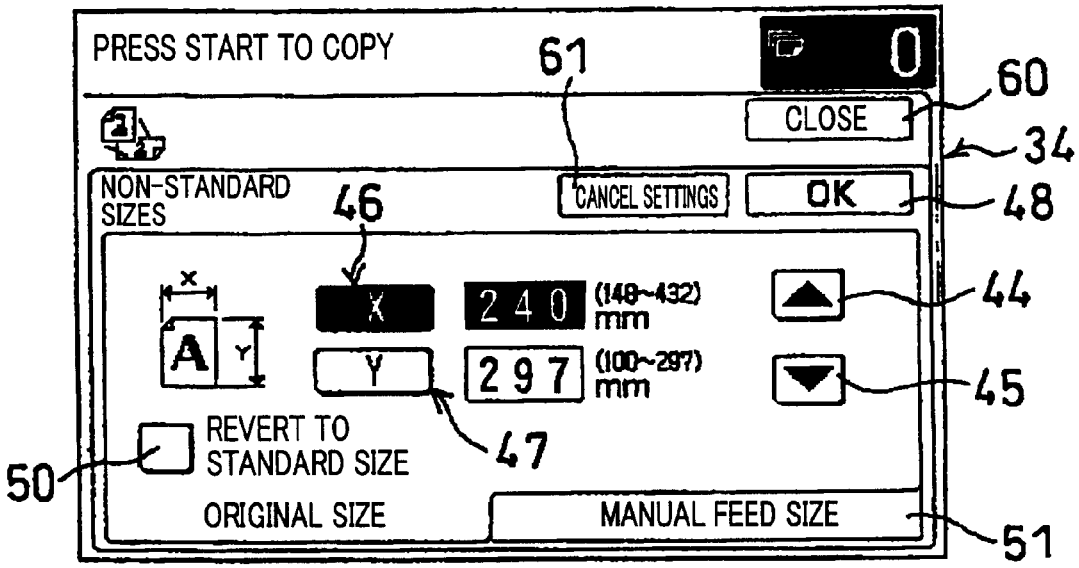
FIG. 6 is a plan view showing a non-standard size input screen displayed on the display section of the operation panel, where the user can input a non-standard original document size.

Next, by selectively pressing a non-standard size key 43 among the image editing functions appearing on the image editor selection screen 33, the operator finally reaches a non-standard size input instruction screen (original document size input means through which the operator manually inputs a non-standard size of an original document or recording paper) 34 shown in FIG. 6. The non-standard size input instruction screen 34 here is an operation screen enabling an input of non-standard size information of an original document. Another operation screen enabling an input of non-standard size information of a recording paper will be descried in embodiment 2.

Under these conditions, the digital copying machine is fed, as an example, with an original document measuring 240 mm in width (x-direction) and 260 mm in height (y-direction).

Then, numerical values are displayed on the nonstandard size input instruction screen 34 near its center before proceeding further. The numerical values represent the original document size information in the x- and y-directions as are obtained in the aforementioned manner by the original document size detector device mounted to the copying machine main body and will be used as a reference (starting point). In this example, the original document fed to the copying machine is detected as being A4.

Since A4 is 210 mm in the x-direction and 297 mm in the y-direction as shown in FIG. 8, the non-standard size input instruction screen 34 shows these figures on it (the value of x not shown in the figure) as reference dimensions (reference values) before proceeding further.

Starting from the reference values (starting point), the operator now inputs the actual original document size in millimeters, by pressing either an incremental key 44 or a decremental key 45 (value adjusting operation means) appearing on screen on the right-hand side at mid-height.

As the non-standard size input instruction screen 34 is displayed to allow input by the operator, an X key 46 is automatically selected and turned on (see FIG. 6). The X key 46 appears on screen near the center and serves as original document reference value adjusting means enabling the operator to give an instruction to switch to an original document size input mode for the x-direction. Then, starting from the reference value (starting point) X=210 mm, the operator changes the assumed original document dimension in the x-direction by pressing either the incremental key 44 or the decremental key 45 as an instruction input.

In this example, the operator changes the value from X=210 mm to =240 mm by pressing the incremental key 44 as shown in the figure.

To change the assumed original document dimension in the y-direction, the operator presses a Y key (original document reference value adjusting means) 47 appearing on screen near the center, to effect switching from an original document size input mode for the x-direction to an original document size input mode for the y-direction. After the switching, the operator can change the assumed y-dimension by pressing either the incremental key 44 or the decremental key 45 as an instruction input, starting from the reference value (starting point) Y=297 mm, just as he/she has done with the x-dimension. In this example, the operator changes the value from Y=297 mm to Y=260 mm by pressing the decremental key 45.

This completes a size input instruction for a case where an original document of a non-standard size is placed on the original document platen 1 of the digital copying machine. As the operator presses an OK key 48 appearing on the non-standard size input instruction screen 34 near the upper right corner, input instructions are confirmed as to the non-standard original document size in both the x-direction and the y-direction.

Figure 5:
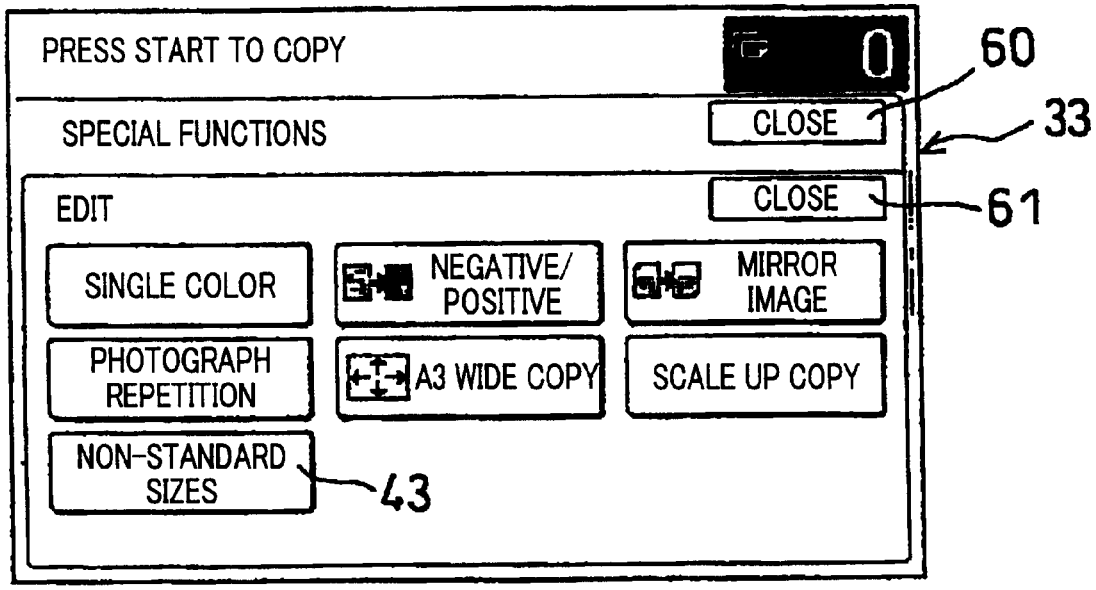
FIG. 5 is a plan view showing an image editor selection screen displayed on the display section of the operation panel.

In response to the pressing of the OK key 48 to confirm the non-standard original document size input, the display goes back from the non-standard size input instruction screen 34 to the immediately previous image editor selection screen 33 shown in FIG. 5. If the display further goes back from the image editor selection screen 33 to the default screen 31, the original document size information (here, A4) as is created by the original document size detector device mounted to the digital copying machine is not displayed in the original document size information display. section 49 produced on the default screen 31 near the upper right corner; instead, a message "Non-standard," for example, is displayed (not shown in the figures) indicating that the original document has a non-standard size.

As shown in FIG. 6, a detected size restoration key (restoration means) 50 is provided on the nonstandard size input instruction screen 34 near the lower left corner to restore the original document size information (here, A4) automatically created by the original document size detector device mounted to the digital copying machine.

Figure 7:
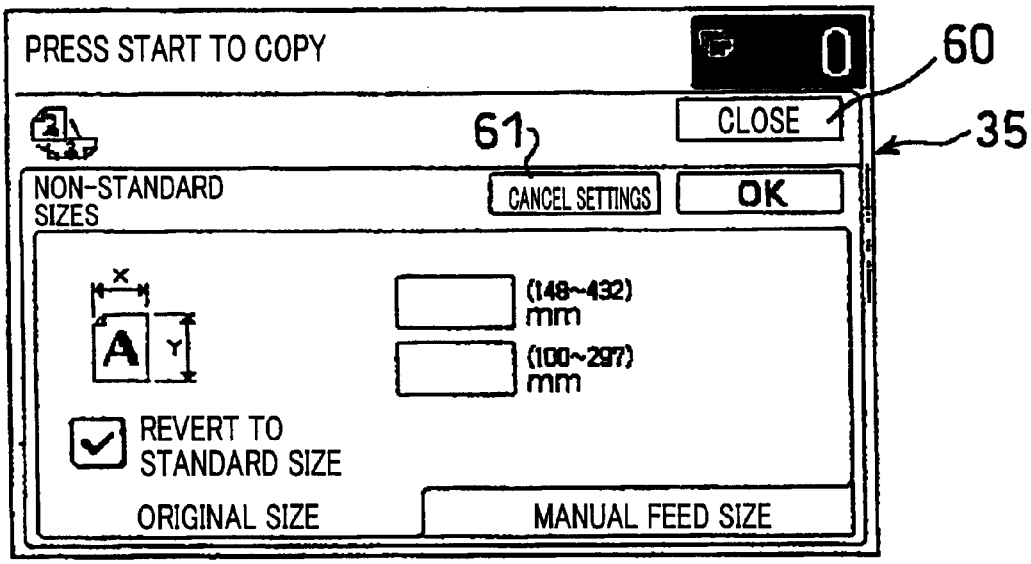
FIG. 7 is a plan view showing a non-standard size input instruction screen displayed on the display section of the operation panel, where the user can input a nonstandard original document size.

Accordingly, as the detected size restoration key 50 is pressed, the display changes to the non-standard size input screen 35 shown in FIG. 7, and the original document size information in the x- and y-directions displayed on the non-standard size input instruction screen 34 near the center is deleted.

Every one of the display screens 31 to 35 among which the display is changed back and forth is provided with a close key 60 near the upper right corner, enabling the operator to cancel the special function select mode and cause the display screen to revert one by one to the default screen 31 by pressing the close key 60. Each of the display screens 34, 35 is provided with a setting cancellation key 61 near the upper right corner for the purpose of cancelling the non-standard size input mode and reverting to the display screen 33 where one of image editor modes is selectable. Further, as shown in FIG. 5, the display screen 33 where one of image editor modes is selectable is provided with a close. key 61 near the upper right corner, offering means to the operator to revert to the immediately preceding special function selection screen 32 by pressing the close key 61.

Throughout the description so far, input instructions were given in millimeters; other alternatives are possible where the instructions are given by means of numerical values attached to equally spaced markings or symbols or similarly predetermined resolution units.

FIG. 8 is a list of original document sizes that are detectable to the digital copying machine of the present embodiment. When the operator presses the nonstandard size key 43, the digital copying machine displays reference values (starting point) beside the X key 46 and the Y key 47 on the non-standard size input instruction screen 34 based on the original document size information in the x- and y-directions of each detected size contained in the list.

Throughout the description here, reference values (starting point) in the x- and y-directions are set to actual values corresponding to original document size information based on the obtained original document size information in reference to a standard size. The starting point may be determined otherwise. For example, the original document size information may be divided into a small size group and a large size group to display predetermined numerical values suitable for the size groups as reference values (starting point) in the x- and y-directions in the first place. When this is the case, reference values can be more appropriately set for original documents of non-standard sizes, which enables the operator to input the actual values with less adjustment.

By the foregoing steps, in the digital copying machine in accordance with the present invention, an image recording process is carried out based on the image information obtained in a reading process of an original document image according to the original document size, as well as based on the original document size information input by the operator.

As a result, when the operator is to manually input non-standard original document size, the device provides reference values (starting point) based on size information automatically obtained by the digital copying machine and then the operator inputs (adjusts) the non-standard original document size. The arrangement thus helps the operator cut down on the time required to input (adjust) the actual size. Especially, the incremental key 44 and the decremental key 45 enable the operator to start the adjustment from reference values provided by the device, rather than to directly input numerical values. The operator therefore needs less time in pressing keys to input a desired size (numerical values)

As described above, the digital copying machine of the present embodiment includes an original document size detector device for detecting a size of an original document to be processed and a non-standard size input instruction screen 34 for allowing input of size information of an original document to be processed. Normally, i.e., when the original document is of a standard size, the original document size detector device detects the original document size and original document image data is processed based on the obtained original document size information to reproduce an image on paper of a corresponding size.

Therefore, for example, to duplicate a non-standard size original document, the operator can manually input the original document size information through the non-standard size input instruction screen 34.

In a conventional digital copying machine, the operator had to directly input numerical values to manually set original document size information and operability was low.

Accordingly, in the present embodiment, the non-standard size input instruction screen 34 is provided with the X key 46 and the Y key 47, enabling the operator to, when inputting original document size information, select and input new original document size information using the incremental key 44 or the decremental key 45 after reference values are provided based on original document size information obtained by the original document size detector device.

Specifically, to input an original document size, reference values are automatically provided by the digital copying machine in accordance with the present invention based on the original document size information obtained by the original document size detector device. To input actual original document size information, new original document size information is selected and input using the incremental key 44 or the decremental key 45 only by the deviation from the reference values. This facilitates the input of the original document size information. These reference values are provided based on the original document size information obtained by the original document size detector device.

If the reference value equals 0, for example, the operator must start at the reference value 0 and keep pressing the incremental key 44 or the decremental key 45 all the way up to a desired numerical value. This is time still consuming, and operability is low.

However, in the present embodiment, as mentioned earlier, original document size information obtained by the original document size detector device, such as, standard size information comparable to the size of an original document fed into the device or size information corresponding to a predetermined size group, can be set in advance as reference values. The operator therefore only needs to adjust the values up or down from these reference values and thereby can cut short the time to press the incremental key 44 or the decremental key 45.

As a result, the digital copying machine can successfully offer improved operability in manually inputting original document size information.

Further, in the digital copying machine of the present embodiment, the original document size detector device detects an original document size in reference to a standard size, while the non-standard size input instruction screen 34 allows an input of an original document size in predetermined resolution unit values.

Since a conventional original document size detector device also detects an original document size in reference to a standard size, an existent original document size detector device can be utilized in the digital copying machine of the present embodiment. Cost increases are thereby curbed.

In addition, since the operator can input an original document size in predetermined resolution unit values, equally spaced markings, numerical values, symbols, etc. can be used. Operability thus improves further.

Moreover, in the present embodiment, the nonstandard size input instruction screen 34 is provided with a detected size restoration key (restoration means) 50. Accordingly, the operator can quickly revert from the input of the size of an original document which is nonstandard to the standard state, i.e., the display of the paper size detected by the original document size detector device, by pressing the detected size restoration key 50.

Convenience is thus improved.

The present invention is not limited to the embodiment and may be varied in many way without departing from the spirit and scope of the present invention. For example, in the embodiment, the value adjusting operation means was embodied as the incremental key 44 or the decremental key 45, but may be embodied otherwise. For example, a volume dial or lever may be used instead to adjust the numerical values up or down from the reference values.

[Embodiment 2]

Figure 9:
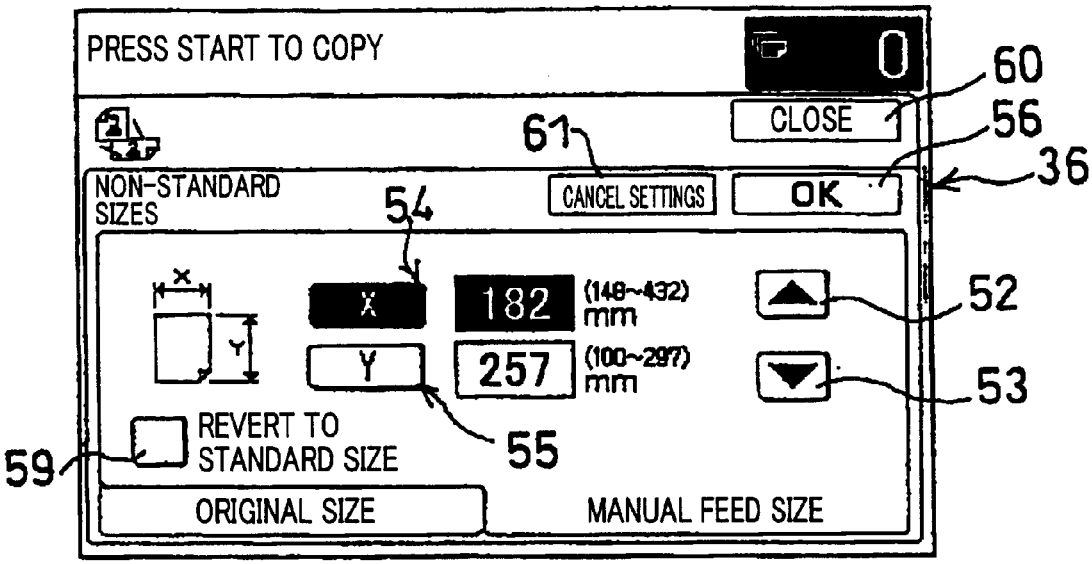
FIG. 9, illustrating another embodiment of the digital copying machine in accordance with the present invention, is a plan view showing a non-standard size input instruction screen displayed on a display section of an operation panel, where the user can input the size of manually fed paper.
Figure 10:
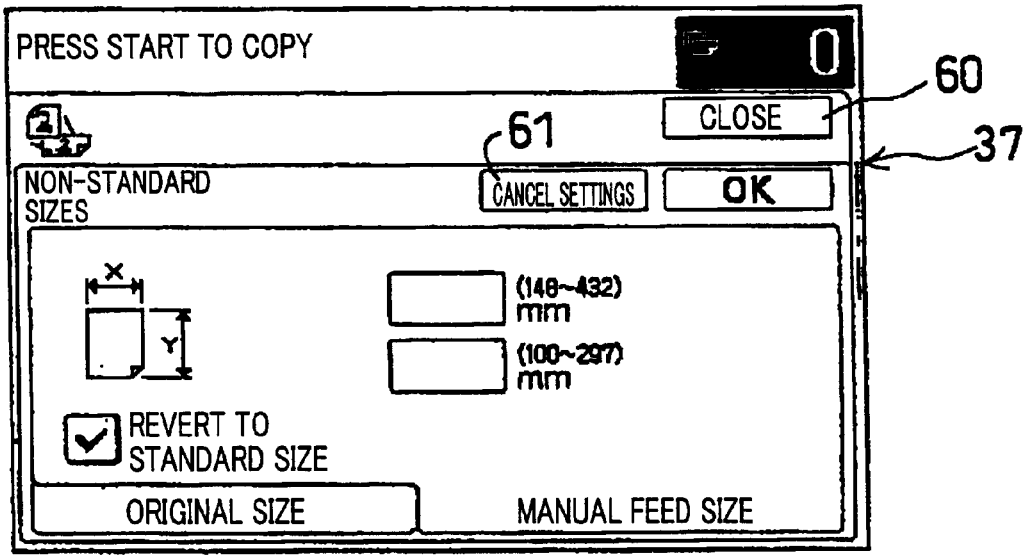
FIG. 10 is a plan view showing a non-standard size input screen displayed on the display section of the operation panel, where the user can input a non-standard size of manually fed paper.

Referring to FIG. 9 and FIG. 10, the following will describe another embodiment of the present invention. Here, for convenience, members of the present embodiment that have the same arrangement and function as members of the previous embodiment, and that are mentioned in it are indicated by the same reference numerals and description thereof is omitted.

The various features described in embodiment 1 are commonly shared by the present embodiment.

The present digital copying machine of the present embodiment (the present digital copying machine) will be described as to on-screen operations to input size information of paper (recording material) placed in a manual feed paper tray.

Since the paper stored in a paper cassette (not shown) is of a standard size, there should be no problem at all with the paper size. However, paper of any size can be placed in the manual feed paper tray, and the copying machine must be adapted to handle that paper size. Accordingly, the present embodiment will be described in terms of manual input of a size of paper placed in a manual feed paper tray.

The present digital copying machine is provided with a paper size detector device (not shown). Therefore, the present digital copying machine can identify the size of the paper placed in the manual feed paper tray as long as it is of a standard size.

The manual feed paper tray is provided with a guide for controlling paper from the its sides. The present digital copying machine can detect the width of standard size paper placed in the manual feed paper tray according to control positions of the guide on the manual feed paper tray.

The length of the paper, measured parallel to the transport direction, is detected by a paper sensor (not shown) . In other words, a paper sensor (not shown) is provided in a paper transport path inside a device main body of the present digital copying machine. The present digital copying machine detects the dimension of the paper in the transport direction by means of time elapsed from the start to end of the detection of the paper passing through the paper transport path by the sensor.

As a result, the paper size detector device (recording material size detector means) is constituted by the paper sensor and the guide on the manual feed paper tray.

In the present embodiment, normally, i.e., when the paper is of a standard size, the paper size detector device determines the paper size. For paper of a nonstandard size, the operator can set any given size.

A paper size input screen is displayed as below.

As shown in FIG. 3, the display section 30 of the operation panel displays the default screen 31. The operator then presses the special function key 41 appearing on the default screen 31 near the upper left corner of the display section 30, causing the display on the display section 30 to change to the special function selection screen 32 shown in FIG. 4. Subsequently, the operator selectively presses the image edit menu key 42 among the special functions appearing on the special function selection screen 32, causing the display on the display section 30 to change to the image editor selection screen 33 shown in FIG. 5.

Next, selectively pressing the non-standard size key 43 among the image editing functions appearing on the image editor selection screen 33, the operator finally reaches the non-standard size input instruction screen 34 appearing on the display section 30 as shown in FIG. 6 described in embodiment 1, where the operator can manually input a non-standard original document size.

The non-standard size input instruction screen 34 here is an operation screen enabling the operator to input a non-standard original document size. As the operator presses a tag below a manual feed paper size key 51 on the non-standard size input instruction screen 34, the display changes from the non-standard size input instruction screen 34 to a manual feed non-standard size input instruction screen (recording material size input means) 36 shown in FIG. 9.

In the present embodiment, in this display, the paper size information in the x- and y-directions currently obtained by the paper size detector device mounted to the digital copying machine is displayed as reference values (starting point) in numerical values before proceeding further. For example, if the paper is detected as being B5, X=182 mm and Y=257 mm are displayed as shown in the figure.

If the paper is of a different size, the operator inputs the actual original document size in millimeters, starting from the reference values (starting point), by pressing either an incremental key 52 or a decremental key 53 (value adjusting operation means) appearing on screen on the right-hand side at mid-height.

As the manual feed non-standard size input instruction screen 36 is displayed, an X key 54 is automatically selected and turned on. The X key 54 appears on screen near the center and serves as recording material reference value adjusting means enabling the operator to give an instruction to switch to a paper size input mode for the x-direction. Then, starting from the reference value (starting point:=182 mm in this case), the operator changes the assumed paper dimension in the x-direction by pressing either the incremental key 52 or the decremental key 53 as an instruction input.

To change the assumed paper dimension in the y-direction, the operator presses a Y key (recording material reference value adjusting means) 55 appearing on screen near the center, to cause the recording material reference value adjusting means to switch from a paper size input mode for the x-direction to a paper size input mode for the y-direction. After the switching, the operator can change the assumed y-dimension by pressing either the incremental key 52 or the decremental key 53 as an instruction input, starting from the reference value (starting point: Y=257 mm in this case) just as he/she has done with the x-dimension.

This completes a size input instruction for a case where paper of a non-standard size is placed in the manual feed paper tray of the digital copying machine. As the operator presses an OK key 56 appearing on the manual feed non-standard size input instruction screen 36 near the upper right corner, input instructions are confirmed as to the non-standard paper size in both the x-direction and the y-direction.

In response to the pressing of the OK key 56 to confirm the non-standard paper size input, the display goes back from the manual feed non-standard size input instruction screen 36 to the immediately previous image editor selection screen 35 shown in FIG. 5 and further to the default screen 31. Under these circumstances, the paper size information (here, B5 size) as is created by the paper size detector device in the manual feed tray mounted to the digital copying machine is not displayed in the manual feed paper size information display section 57 produced on the default screen 31 near the upper right corner in FIG. 3; instead, a message "Non Standard," for example, is displayed (not shown in the figures) indicating that the paper has a non-standard size.

Further, on the default screen 31 and the special function selection screen 32, a message "Non Standard" indicating the size of the paper loaded in the manual feed paper tray is displayed on the bottom near the center in paper size information 58 selected by the digital copying machine as a tray from which paper can be fed.

On the default screen 31 and the special function selection screen 32, the size information of paper loaded in the manual feed paper tray can be displayed in the form of x- and y-dimensions (input numerical values in millimeters), as well as in the form of message "Non Standard."

As shown in FIG. 9, a detected size restoration L key 59 is provided on the manual feed non-standard size input instruction screen 36 near the lower left corner to restore the paper size information (here, B5) automatically created by the manual feed paper size detector device mounted to the digital copying machine.

Accordingly, as the operator presses the detected size restoration key 59, the display changes to the manual feed paper non-standard size input screen 37 shown in FIG. 10, and the size information of the manually fed paper in the x- and y-directions displayed on the manual feed non-standard size input instruction screen 36 near the center is deleted.

In the present embodiment, every one of the display screens 36, 37 is again provided with a close key 60 near the upper right corner, enabling the operator to cancel the special function select mode and cause the display screen to revert one by one to the default screen 31 by pressing the close key 60. Each of the display screens 34, 35 is provided with a setting cancellation key 61 near the upper right corner for the purpose of cancelling the non-standard size input mode and reverting to the display screen 33 where one of image editor modes is selectable.

Throughout the description so far, input instructions were given in millimeters; other alternatives are possible where the instructions are given by means of numerical values attached to equally spaced markings or symbols or similarly predetermined resolution units.

A list of paper sizes that are detectable to the digital copying machine of the present embodiment is shown again in FIG. 8. When the operator presses the non-standard size key 43, the digital copying machine displays reference values (starting point) on the manual feed non-standard size input instruction screen 36 based on the size information in the x- and y-directions of each detected size contained in the list.

By the foregoing steps, an image recording process is carried out based on the image information obtained in a reading process of an original document image according to the paper size, as well as based on the paper size information.

As a result, the operator, when manually inputting a non-standard paper size, can input (adjust) the non-standard recording material size, starting from reference values (starting point) given by the device based on size information of the paper automatically detected by the digital copying machine. The arrangement thus helps the operator cut down on the time required to input (adjust) the actual size. Especially, the incremental key 52 and the decremental key 53 enable the operator to start the adjustment from reference values provided by the device, rather than to directly input numerical values. The operator therefore needs less time in pressing the incremental key 52 or decremental key 53 to input a desired size (numerical values).

Further, the arrangement allows the operator to input instructions regarding non-standard sizes of paper in a manual feed tray in which paper is frequently replaced and loaded and non-standard size paper is most likely to be loaded then in any other part of the digital copying machine; therefore, the recording process can be carried out on the original document image exactly as required by the user.

As described above, the digital copying machine of the present embodiment includes a paper size detector device for detecting a size of paper on which an image is recorded and a manual feed non-standard size input instruction screen 36 for allowing input of a size of a recording material (paper) on which an image is recorded. Normally, the paper size detector device detects the paper size and image data is processed based on the obtained paper size information to reproduce an image on paper of a corresponding size.

Therefore, for example, to reproduce an image on non-standard paper, the operator can manually input the paper size through the manual feed non-standard size input instruction screen 36.

If the operator has to directly input numerical values to manually set a paper size, operability is low.

Accordingly, in the digital copying machine of the present embodiment, the manual feed non-standard size input instruction screen 36 is provided with the X key 54 and the Y key 55, enabling the operator to, when inputting a paper size, select and input new paper size information using the incremental key 52 or the decremental key 53 after reference values are provided based on paper size information obtained by the paper document size detector device.

Specifically, to input a paper size into the digital copying machine of the present embodiment, reference values are automatically provided based on the paper size information obtained by the paper size detector device. To input an actual original document size, the operator selects and inputs new paper size information using the incremental key 52 or the decremental key 53 only by the deviation from the reference values. This facilitates the input of the paper size. These reference values are provided based on the paper size information obtained by the paper size detector device.

If the reference value equals 0, for example, the operator must start at the reference value 0 and keep pressing the incremental key 52 or the decremental key 53 all the way up to a desired numerical value. This is time still consuming, and operability is low.

However, in the present embodiment, as mentioned earlier, recording material size information obtained by the paper size detector device, such as, standard size information comparable to the size of a recording material fed into the device or size information corresponding to a predetermined size group, can be set in advance as reference values. The operator therefore only needs to adjust the values up or down from these reference values and thereby can cut short the time to press the incremental key 52 or the decremental key 53.

As a result, the digital copying machine can successfully offer improved operability in manually inputting a paper size.

Further, in the digital copying machine of the present embodiment, the paper size detector device detects a paper size in reference to a standard size, while the manual feed non-standard size input instruction screen 36 allows an input of a paper size in predetermined resolution unit values.

Since a conventional paper size detector device also detects a paper size in reference to a standard size, an existent paper size detector device can be utilized in the digital copying machine of the present embodiment. Cost increases are thereby curbed.

In addition, since the operator can input a paper size in predetermined resolution unit values, equally spaced markings, numerical values, symbols, etc. can be used operability thus improves further.

Moreover, in the digital copying machine of the present embodiment, the manual feed non-standard size input instruction screen 36 allows the operator to input a size of paper loaded in the manual feed tray.

Therefore, in the digital copying machine of the present embodiment, the arrangement allows the operator to input the size of paper loaded in a manual feed tray in which a recording material can be readily replaced and loaded. Convenience is thus improved. The digital machine is therefore often used.

Moreover, in the present embodiment, the manual feed non-standard size input instruction screen 36 is provided with a detected size restoration key (restoration means) 59. Accordingly, the operator can quickly revert from the input of the size of paper which is non-standard to the standard state, i.e., the display of the paper size detected by the paper size detector device, by pressing the detected size restoration key 59.

Convenience is thus improved.

The present invention is not limited to the embodiment and may be varied in many way without departing from the spirit and scope of the present invention. For example, in the embodiment, the value adjusting operation means was embodied as the incremental key 52 or the decremental key 53, but may be embodied otherwise. For example, a volume dial or lever may be used instead to adjust the numerical values up or down from the reference values.

The image forming apparatus in accordance with the present invention, as described so far, includes:

original document size detector means for detecting a size of an original document to be processed; and original document size input means for allowing input of a size of an original document to be processed, wherein:

normally, the original document size detector means detects the size of the original document, and original document image data is processed based on obtained original document size information to reproduce an image on a recording material of a corresponding size; and the original document size input means is provided with original document reference value adjusting means that enables, when inputting the size of the original document, selection and input of new original document size information using value adjusting operation means, such as an incremental key or a decremental key, after reference values are provided based on original document size information obtained by the original document size detector means.

According to the invention, the image forming apparatus includes original document size detector means for detecting a size of an original document to be processed; and original document size input means for allowing input of a size of an original document to be processed. Normally, the original document size detector means detects the size of the original document, and original document image data is processed based on obtained original document size information to reproduce an image on a recording material of a corresponding size.

Therefore, for example, when the operator is to make a photocopy of an original document of a non-standard size, the original document size input means allows the operator to manually input the size of the original document.

In a conventional image forming apparatus, the operator had to directly input numerical values to manually set an original document size and operability was low.

Accordingly, in the present embodiment, the original document size input means is provided with original document reference value adjusting means. Owing to the provision of the original document reference value adjusting means, the image forming apparatus enables the operator to, when inputting an original document size, select and input new original document size information using the value adjusting operation means, such as an incremental key or a decremental key, after reference values are provided based on original document size information obtained by the original document size detector means.

In other words, in the present invention, to input the size of the original document, the original document reference value adjusting means first provides reference values based on the original document size information obtained by the original document size detector means. Then, the operator, to actually input the size of the original document, selects and inputs new original document size information using an incremental key or a decremental key only by the deviation from the reference values. This facilitates the input of the original document size.

These reference values are provided based on the original document size information obtained by the original document size detector means. If the reference value equals 0, for example, the operator must start at the reference value 0 and keep pressing the incremental key or the decremental key all the way up to a desired numerical value. This is time still consuming, and operability is low.

However, in the present embodiment, as mentioned earlier, original document size information obtained by the original document size detector means, such as, standard size information comparable to the size of an original document fed into the device or size information corresponding to a predetermined size group, can be set in advance as reference values. The operator therefore only needs to adjust the values up or down from these reference values and thereby can cut short the time to operate value adjusting operation means, such as an incremental key and a decremental key.

As a result, the image forming apparatus can successfully offer improved operability in manually inputting an original document size.

The image forming apparatus in accordance with the present invention, as described so far, includes all the features of the aforementioned image forming apparatus and is preferably arranged so that: the original document size detector means detects the size of the original document in reference to a standard size; and the original document size input means allows input of the size of the original document in predetermined resolution unit values.

According to the invention, the original document size detector means detects the size of the original document in reference to a standard size. The original document size input means allows input the size of the original document in predetermined resolution unit values.

Since a conventional original document size detector means also detects the size of the original document in reference to a standard size, an existent original document size detector device can be utilized. Cost increases are thus curbed.

In addition, since the operator can input the size of the original document in predetermined resolution unit values, equally spaced markings, numerical values, symbols, etc. can be used. Operability thus improves further.

The image forming apparatus in accordance with the present invention, as described so far, includes:

recording material size detector means for detecting a size of a recording material on which an image is recorded; and recording material size input means for allowing input of a size of a recording material on which an image is recorded, wherein:

normally, the recording material size detector means detects the size of the recording material, and image data is processed based on the obtained recording material size information to reproduce an image on a recording material of a corresponding size; and the recording material size input means is provided with recording material reference value adjusting means that enables, when inputting the size of the recording material, selection and input of new recording material size information using value adjusting operation means, such as an incremental key and a decremental key, after reference values are provided based on recording material size information obtained by the recording material size input means.

According to the invention, the image forming apparatus includes recording material size detector means for detecting a size of a recording material on which an image is recorded; and recording material size input means for allowing input of a size of a recording material on which an image is recorded. Normally, the recording material size detector means detects the size of the recording material, and image data is processed based on the obtained recording material size information to reproduce an image on a recording material of a corresponding size.

Therefore, for example, when the operator is to reproduce an image on a recording material of a nonstandard size, the recording material size input means allows the operator to manually input the size of the recording material.

If the operator has to directly input numerical values to manually set a recording material size, operability is low.

Accordingly, in the present embodiment, the recording material size input means is provided with recording material reference value adjusting means. In addition, in the image forming apparatus, when inputting the size of the recording material, owing to the recording material reference value adjusting means, reference values are provided based on recording material size information obtained by the recording material size detector means. This enables the operator to select and input new recording material size information using the value adjusting operation means, such as an incremental key and a decremental key.

Specifically, in the present invention, to input the size of the recording material, the recording material reference value adjusting means provides reference values based on recording material size information obtained by recording material size detector means. To input an actual size of the recording material, the operator selects and inputs new recording material size information using, for example, the incremental key or the decremental key only by the deviation from the reference values. This facilitates the input of the size of the recording material.

These reference values are provided based on the recording material size information obtained by the recording material size detector device. If the reference value equals 0, for example, the operator must start at the reference value 0 and keep selecting and inputting using the incremental key or the decremental key all the way up to a desired numerical value. This is time still consuming, and operability is low.

However, in the present embodiment, as mentioned earlier, recording material size information obtained by the recording material size detector device, such as, standard size information comparable to the size of a recording material fed into the device or size information corresponding to a predetermined size group, can be set in advance as reference values. The operator therefore only needs to adjust the values up or down from these reference values and thereby can cut short the time to operate the value adjusting operation means, such as an incremental key or a decremental key. As a result, the image forming apparatus can successfully offer improved operability in manually inputting the size of the recording material.

The image forming apparatus in accordance with the present invention, as described so far, includes all the features of the aforementioned image forming apparatus and is preferably arranged so that:

the recording material size detector means detects the size of the recording material as a standard size; and the recording material size input means inputs the size of the recording material in predetermined resolution unit values.

According to the invention, the recording material size detector means detects the size of the recording material in reference to a standard size and allows the operator to input the size of the recording materials in predetermined resolution unit values.

Since a conventional recording material size detector means also detects the size of the recording material in reference to a standard size, existent recording material size detector means can be utilized. Cost increases are thus curbed.

In addition, since the operator can input the size of the recording material in predetermined resolution unit values, equally spaced markings, numerical values, symbols, etc. can be used. Operability thus improves further.

The image forming apparatus in accordance with the present invention, as described so far, includes all the features of the aforementioned image forming apparatus and is preferably arranged so that:

the recording material size input means enables the operator to input the size of the recording material loaded in a manual feed tray.

According to the invention, the recording material size input means enables the operator to input the size of the recording material loaded in a manual feed tray.

Therefore, in the image forming apparatus, the arrangement allows the operator to input the size of the recording material loaded in a manual feed tray in which a recording material can be readily replaced and loaded. Convenience is thus improved.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

original document size detector means for detecting a size of an original document to be processed; and original document size input means for allowing input of a size of an original document to be processed, wherein:

normally, the original document size detector means detects the size of the original document, and original document image data is processed based on obtained original document size to reproduce an image on a recording material of a corresponding size; and the original document size input means is provided with value adjusting operation means that enables, when inputting the size of the original document, a setting of new original document size by being supplied with a difference between an actual document size and reference values after the reference values are provided based on original document size obtained by the original document size detector means.

2. The image forming apparatus, as defined in claim 1, wherein:

the original document size detector means detects the size of the original document in reference to a standard size; and the original document size input means allows input of the size of the original document in predetermined resolution unit values.

3. The image forming apparatus, as defined in claim 1, wherein:

the value adjusting operation means includes an incremental key and a decremental key.

4. The image forming apparatus, as defined in claim 1, wherein:

the value adjusting operation means includes a volume dial.

5. The image forming apparatus, as defined in claim 1, wherein:

the value adjusting operation means includes a lever.

6. The image forming apparatus, as defined in claim 1, wherein:

the original document size input means is provided with restoration means for, after inputting new original document size through the value adjusting operation means, restoring a display of the size of the original document as detected by the original document size detector means.

7. The image forming apparatus, as defined in claim 1, wherein:

the value adjusting operation means divides the original document size obtained by the original document size detector means into a small size group and a large size group and provides as the reference values predetermined values according to the divided size groups.

8. An image forming apparatus, comprising:

original document size detector means for detecting a size of an original document to be processed in reference to at least two standard sizes; and original document size input means for allowing input of a size of an original document to be processed, wherein:

original document image data is processed based on the size of the original document input through the original document size input means to reproduce an image on a recording material of a corresponding size;

the original document size input means is provided with value adjusting operation means that enables, when inputting the size of the original document, a setting of new original document size by being supplied with a difference between an actual document size and reference values after the reference values are provided based on original document size obtained by the original document size detector means in reference to at least two standard sizes.

9. An image forming apparatus, comprising:

recording material size detector means for detecting a size of a recording material on which an image is recorded; and recording material size input means for allowing input of a size of a recording material on which an image is recorded, wherein:

normally, the recording material size detector means detects the size of the recording material and image data is processed based on the obtained recording material size to reproduce an image on a recording material of a corresponding size;

the recording material size input means is provided with value adjusting operation means that enables a setting of new recording material size by being supplied with the difference between an actual recording material size and reference values after the reference values are provided based on recording material size obtained by the recording material size detector means.

10. The image forming apparatus, as defined in claim 9, wherein:

the recording material size detector means detects the size of the recording material in reference to a standard size; and the recording material size input means allows input of the size of the recording material in a predetermined resolution unit values.

11. The image forming apparatus, as defined in claim 9, wherein:

the recording material size input means allows input of the size of the recording material loaded in a manual feed tray.

12. The image forming apparatus, as defined in claim 9, wherein:

the value adjusting operation means includes an incremental key and a decremental key.

13. The image forming apparatus, as defined in claim 9, wherein:

the value adjusting operation means includes a volume dial.

14. The image forming apparatus, as defined in claim 9, wherein:

the value adjusting operation means includes a lever.

15. The image forming apparatus, as defined in claim 9, wherein:

the recording material size input means is provided with restoration means for, after inputting new recording material size through the value adjusting operation means, restoring a display of the size of the recording material as detected by the recording material size detector means.

16. An image forming apparatus, comprising:

recording material size detector means for detecting a size of a recording material to be processed in reference to at least two standard sizes; and recording material size input means for allowing input of a size of a recording material to be processed, wherein:

image data is processed based on the size of the recording material input through the recording material size input means to reproduce an image on a recording material of a corresponding size;

the recording material size input means is provided with value adjusting operation means that enables a setting of new recording material size by being supplied with the difference between an actual recording material size and reference values after the reference values are provided based on recording material size obtained by the recording material size detector means in reference to at least two standard sizes.

* * * * *